US011641927B1

(12) United States Patent
Kwiatkowski

(10) Patent No.: US 11,641,927 B1
(45) Date of Patent: May 9, 2023

(54) COMBINATION DEODORANT AND BODY SPRAY DISPERSER UNIT

(71) Applicant: Bryn Kwiatkowski, Palmyra, NY (US)

(72) Inventor: Bryn Kwiatkowski, Palmyra, NY (US)

( * ) Notice: Subject to any disclaimer, the term of this patent is extended or adjusted under 35 U.S.C. 154(b) by 0 days.

(21) Appl. No.: 17/465,934

(22) Filed: Sep. 3, 2021

Related U.S. Application Data

(60) Provisional application No. 63/075,915, filed on Sep. 9, 2020.

(51) Int. Cl.

| | |
|---|---|
| ***A45D 40/24*** | (2006.01) |
| ***A45D 34/04*** | (2006.01) |
| ***A45D 34/06*** | (2006.01) |
| ***A45D 40/04*** | (2006.01) |
| ***B05B 11/00*** | (2006.01) |

(52) U.S. Cl.
CPC ..... *A45D 40/24* (2013.01); *A45D 34/04* (2013.01); *A45D 34/06* (2013.01); *A45D 40/04* (2013.01); *B05B 11/0037* (2013.01)

(58) Field of Classification Search
CPC ..... A45D 40/24; A45D 34/04; A45D 34/06; A45D 40/04; A45D 33/26; A45D 33/28; A45D 33/30; A45D 33/38; A45D 34/00; A45D 34/02; A45D 40/02; A45D 40/20
USPC ..... 401/16–19, 29
See application file for complete search history.

(56) References Cited

U.S. PATENT DOCUMENTS

| | | | | |
|---|---|---|---|---|
| 3,184,118 | A | 5/1965 | Webster | |
| 5,911,976 | A | 6/1999 | Trinh et al. | |
| 6,010,264 | A | 1/2000 | Scuderi et al. | |
| 6,705,494 | B2 | 3/2004 | Thompson et al. | |
| 7,600,936 | B2 * | 10/2009 | Landow | B05B 11/0035 401/19 |
| 8,191,801 | B2 | 6/2012 | Khan et al. | |
| 2006/0011660 | A1 * | 1/2006 | Sandlin | B65D 25/04 222/321.9 |
| 2007/0241134 | A1 | 10/2007 | Gurrisi et al. | |
| 2014/0014687 | A1 | 1/2014 | Cornwell | |
| 2015/0250289 | A1 * | 9/2015 | Mahfood | B05B 11/30 401/19 |

* cited by examiner

*Primary Examiner* — David J Walczak
(74) *Attorney, Agent, or Firm* — Suzanne Kikel, Patent Agent

(57) ABSTRACT

A combination deodorant and body spray dispenser unit having a deodorant portion on one end and a spray dispenser portion on the other end. The unit comprises a container having a body portion and a cap portion; a deodorant stick movably located inside the body portion of the container for movement into and out of the body portion of the container; a deodorant stick moving system functionally connected to the deodorant stick to move the deodorant stick; and a spray system in the body portion of the container and comprising a spray nozzle, a fluid reservoir in the body portion of the container, and a control button on the body portion of the container, the fluid reservoir being fluidically connected to the spray nozzle through the control button.

6 Claims, 4 Drawing Sheets

COMBINATION DEODORANT AND BODY SPRAY DISPERSER UNIT

CROSS REFERENCE TO RELATED APPLICATIONS

This application claims priority to U.S. Provisional Patent Application Ser. No. 63/075,915 filed Sep. 9, 2020, and entitled "Body Spray and Deodorant Combo", the disclosure of which is incorporated herein by reference in its entirety.

BACKGROUND OF THE INVENTION

1. Field of the Invention

The present invention relates, in general, to personal hygiene, and more particularly to a combination deodorant and body spray dispenser unit for use in personal hygiene.

2. Brief Description of the Prior Art

The human skin is naturally populated with numerous micro-organisms. These organisms are nourished by various skin secreted substances, skin cell debris, breakdown products of the skin and the organisms themselves. The "skin secretions" are eccrine and apocrine sweat, and lipid-soluble sebum. Eccrine sweat is normally odorless and remains odorless after secretion, although odoriferous food and drug substances may be excreted with it. Apocrine glands are normally associated with hair follicles and are confined mainly to the groin, perianal, areola and armpits. Apocrine glands produce a scanty, milky substance that is odorless upon secretion, but becomes odoriferous upon bacterial decomposition. Apocrine glands are considered to be a primary contributor for malodor.

The sebaceous glands are distributed over the skin surface, except for the palms and dorsae. These glands are most numerous on the scalp, forehead, face, back, and chest. The secretion, which is known as "sebum", consists mainly of fatty materials, wax esters, cholesterol, and its esters and squalene. Sebum is typically associated with acne.

Specifically, body odor is most commonly caused by fatty acids on the skin and from malodors from bacterial sources. The unpleasant odors are mainly organic molecules which have different structures and functional groups; such as amines, acids, alcohols, aldehydes, ketones, phenolics, polycyclics, indoles, aromatics, polyaromatics, etc. These unpleasant odors may also be made up of sulfur-containing functional groups; such as thiol, mercaptan, sulfide and/or disulfide groups.

Numerous attempts have been made to conceal body odors through the use of perfumes. Not only are these perfumes often inadequate at fully concealing body odors, but oftentimes they are irritating to the user's skin. Additionally, the perfume odor itself may be irritating and/or offensive to the user's respiratory system and/or olfactory senses, as well as to nearby individuals.

Other attempts have been made to control odor through moisture absorption. Odor-causing bacteria and fungi often flourish in warm, moist conditions; particularly where they have easy access to nourishment, such as skin secretions and/or skin cell debris. Therefore, attempts have been made to deprive the bacteria which are responsible for body odor of the moist/humid environment which they need to proliferate and grow. Such efforts include the use of powders and/or antiperspirants.

Powders and powder-based compositions may be difficult to apply. They may rub or even fall off onto clothing; thereby leaving visible residue on clothing which can be quite embarrassing and inconvenient to the user. Therefore, daily use of the body powders of the prior art may be undesirable and/or ineffective for day-to-day body odor control of the entire body.

Antiperspirants are generally not useful in a body odor control product for use over the entire body as they may tend to interfere with the body's thermal regulatory process by inhibiting perspiration through the action of astringent salts. Additionally, such salts may be irritating to a large number of users; particularly, when applying them to sensitive areas, such as the pelvic region.

Numerous other deodorant compositions aimed at combating odor associated with the skin secretions have been described in the chemical and cosmetic literature. These generally are emulsion sticks or suspensoid sticks; but they may also be aerosols, roll-ons, pads, pump sprays, and even soap bars.

The cosmetic industry has searched many years for ways to enhance the performance of consumer and cosmetic products to make them more aesthetically pleasing to the consumers. Consumer acceptance of cosmetic products is determined not only by the performance achieved with these products, but also the aesthetics associated therewith.

Fragrances are also an important aspect of a successful product, and fragrances are being utilized, in addition to imparting an aesthetically pleasing odor, as sensory markers to convey to the consumer the performance and effectiveness of the product.

Consumers are becoming increasingly educated and they now tend to expect a high level of sophistication in their products, and the market has become extremely competitive. Many consumers prefer that the fragrance in these products last longer or be released only upon need (i.e., during the wash cycle for laundry detergent, upon perspiration for underarm products, and the like). Also, there is a need for controlled-release systems that convey to the consumer the product performance, or signal that the product is activated. A major challenge in designing such systems is ensuring that the consumer easily perceives the signal.

Spray dispensers containing personal care products that are applied topically are often referred to as "body sprays." These body sprays may be used to spray individual selected areas of the body, such as the underarm or foot, or may be used to spray large areas of the body. Such body sprays are generally portable, and include an aerosol canister fitted with an actuator mechanism and spray nozzle at the top of the canister which the user operates to apply the product to the user's skin. The personal care product may include a wide variety of cosmetic and/or skin care ingredients including, for example, fragrances, deodorant agents, antiperspirant agents, botanicals, and moisturizers.

However, the inventor is not aware of any unit which combines both a dispenser for deodorant on one end and a dispenser for a body spray on the opposite end of the unit.

There is, therefore, a need in the art to provide a unit which combines both a dispenser for deodorant and a dispenser for a body spray.

SUMMARY OF THE INVENTION

The present invention meets this need. More particularly, the present invention provides a combination deodorant and body spray dispenser unit, comprising: a container having a body portion and a cap portion, the body portion being hollow and having a side wall with an outer surface; a roll-on deodorant stick having a stick body and an applicator tip and being movably mounted in the body portion of the container for movement into and out of the body portion of the container; a spray system located in the body portion of the container and comprising: a spray nozzle located on the side wall of the body portion; a fluid reservoir located inside the body portion of the container; a control button located on an outer surface of the body portion of the container, the spray nozzle being fluidically connected to the fluid reservoir by the control button; and a locking element located on the side wall of the body portion and functionally connected to the control button; and a deodorant stick moving system comprising: a ring gear movably mounted on the body portion of the container to move around the outer surface of the sidewall of the body portion of the container, the ring gear being annular and having an outer surface and an inner surface; a screw thread on an inner surface of the ring gear; a screw thread affixed to the deodorant stick and having a screw thread threadably engaged with the screw thread on the ring gear to move the deodorant stick into and out of the body portion of the container under the influence of the screw thread on the ring gear when the ring gear is rotated on the body portion.

The combination deodorant and body spray dispenser unit of the invention has a deodorant function on one end thereof and a body spray dispenser function on its opposite end.

These and other features and advantages of the present invention will be better appreciated and understood when the following description is read in light of the accompanying drawings.

BRIEF DESCRIPTION OF THE DRAWINGS

The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
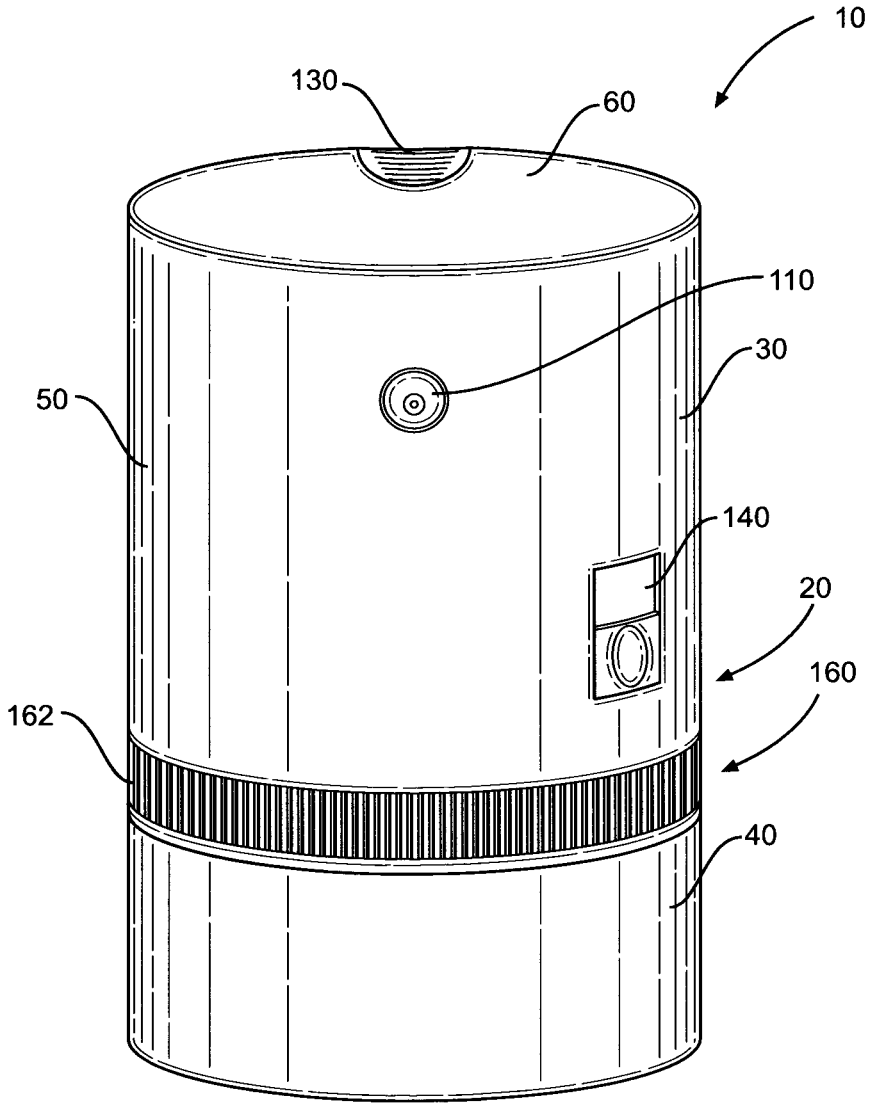
FIG. 1 is a perspective view of a combination deodorant and body spray dispenser unit of the present invention in a spraying configuration and positioning for a body spray dispenser.
Figure 2:
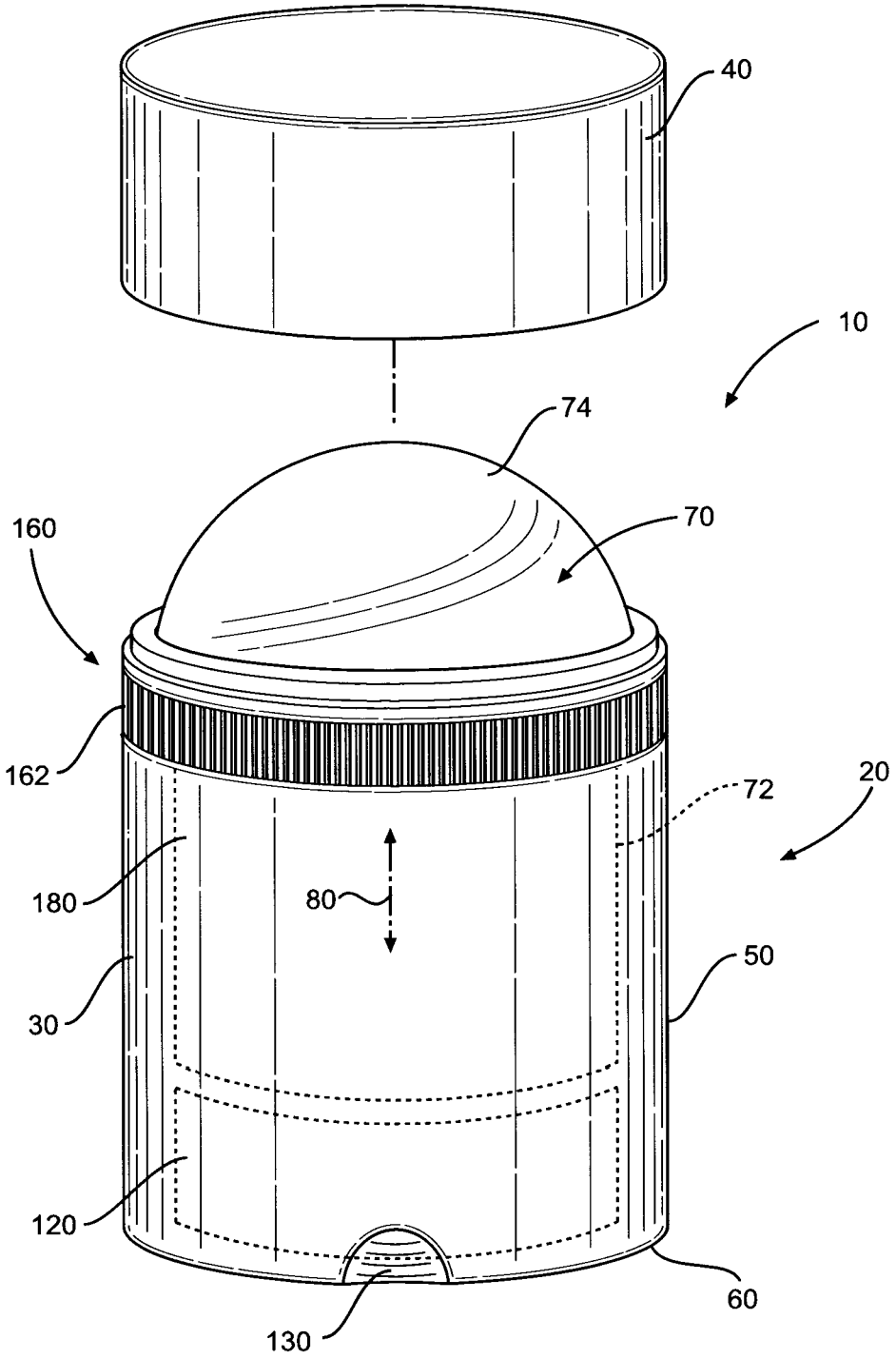
FIG. 2 is a perspective view of the combination deodorant and body spray dispenser unit of FIG. 1 in a roll-on deodorant configuration and positioning.
Figure 4:
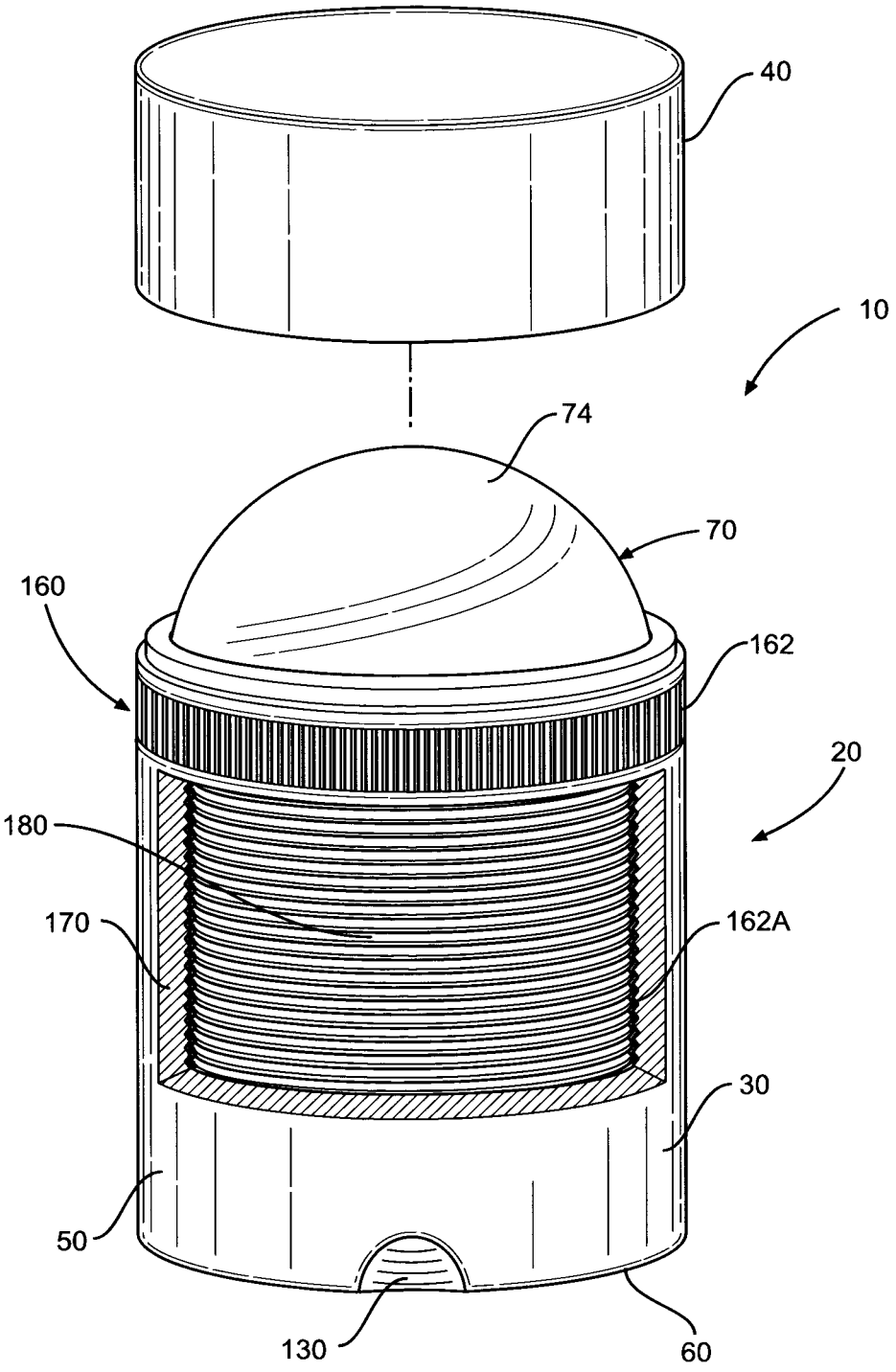
FIG. 4 is a perspective view of the combination deodorant and body spray dispenser unit of the invention of FIG. 2, which is partially broken away to show a moving system for the roll-on deodorant stick.

Referring to FIGS. 1, 2 and 4, the present invention relates to a combination deodorant and body spray dispenser unit 10. Unit 10 comprises a container 20 having a cylindrical shape and having a body portion 30 and a cap portion 40. Body portion 30, in general, is hollow and has a side wall 50 and an outer surface 60.

FIG. 1 shows a cap portion 40 being positioned below body portion 30; whereas FIGS. 2 and 4 show cap portion 40 being positioned above body portion 30. That is, it is to be appreciated that container 20 has been rotated 180 degrees in FIGS. 2 and 4 to present a deodorant configuration of unit 10; whereas FIG. 1 presents a body spray dispenser configuration for unit 10. That is, the combination deodorant and body spray dispenser unit 10 of the invention has a body spray dispenser function at one end and a deodorant function at its other end.

Referring particularly to FIGS. 2 and 4, the combination deodorant and body spray dispenser unit 10 of the invention further comprises a roll-on deodorant stick 70. With particular reference to FIG. 2, roll-on deodorant stick 70 has a body 72 located inside container 20 and shown in FIG. 2 by the broken lines and an applicator tip 74 which extends out of container 20. In a conventional manner, roll-on deodorant stick 70 is constructed and arranged to be movably mounted in container 20 to move upwardly and downwardly therein so as to extend into and out of container 20 of unit 10, as indicated by the double-headed arrow 80 in FIG. 2.

Figure 3:
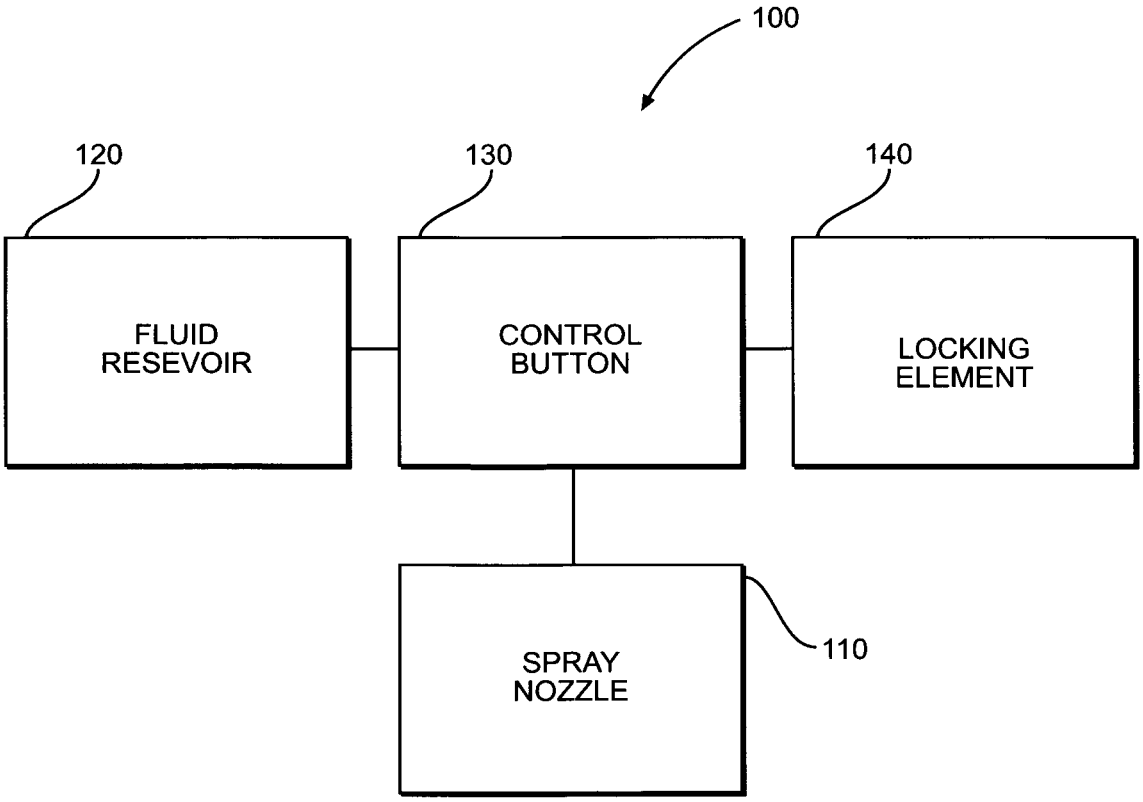
FIG. 3 is a schematic diagram of a fluid circuit associated with the spraying function of the body spray dispenser of the invention.

Even though not shown in FIGS. 1, 2 and 4, it is to be appreciated that the combination deodorant and body spray dispenser unit 10 of the invention also comprises a spray system 100, which is located in the body portion 30 of container 20. As shown in the schematic diagram of FIG. 3, spray system 100 comprises a spray nozzle 110, a fluid reservoir 120, a control button 130 and a locking element 140. As shown in FIG. 1, spray nozzle 110 and locking element 140 are located on the sidewall 50 of body portion 30 of container 20, and control button 130 is located on the outer surface 60 of container 20. It is to be appreciated that fluid reservoir 120, as indicated by the broken lines in FIG. 2, is located inside body portion 30 of container 20 and is associated through suitable means well-known to those skilled in the art with control button 130.

Fluid reservoir 120 is similar to the fluid reservoirs associated with aerosol spray containers, such as those disclosed in U.S. Pat. Nos. 3,184,118 and 8,191,801, the disclosures of which are fully incorporated herein by reference. Those skilled in the art will understand the details of the fluid circuit associated with spray system 100 of the invention. The spray nozzle 110 is fluidically connected to the fluid reservoir 120 by control button 130 in a manner well-known to those skilled in the art. Also, locking element 140, located on the sidewall 50 of container 20 is functionally connected to the control button 130 in a manner well-known to those skilled in the art. With reference particularly to FIG. 2, fluid reservoir 120 is located in container 20 between deodorant stick 70 and the outer surface 60 of container 20.

With particular reference to FIG. 4, unit 10 of the invention further comprises a deodorant stick moving system 160. Deodorant stick moving system 160 comprises a ring gear 162 which is movably mounted on the body portion 30 of container 20 to move around the sidewall 50 of body portion 30. Ring gear 162 has an annular configuration and an outer surface and an inner surface **162*a*. The deodorant stick moving system 160 further comprises a screw thread 170 on the inner surface 162*a* of the ring gear 162 and a screw thread 180 affixed to the deodorant stick 70 for moving deodorant stick 70 into and out of container 20 under the influence of the screw thread 170 on the ring gear 162 when ring gear 162 is rotated on the body portion 30 of container 20. The frictional engagement between screw thread 170 on the inner surface 162*a* of the ring gear 162 and the screw thread 180 on the roll-on deodorant stick 70 is sufficient so that the roll-on deodorant stick 70 is not forced back into body portion 30 of container 20** when used.

It is to be appreciated that when the combination deodorant and body spray dispenser unit 10 of the invention is to perform a body spray operation, container 20 is in the positioning shown in FIG. 1 wherein cap 40 is located below container 20; and when unit 10 is to perform a deodorant operation, container 20 is in the positioning shown in FIGS. 2 and 4 wherein cap 40 is removed from and located above container 20; thus, container 20 is rotated 180 degrees for the desired operation. From the above teachings of the invention, the combination deodorant and body spray dispenser unit 10 of the invention has a deodorant functioning on one end and a body spray functioning on its other end.

While the present invention has been described in connection with the preferred embodiments of the figures, it is to be appreciated and understood that other similar embodiments may be used or modifications and additions may be made to the described embodiments for performing the same function of the present invention without deviating therefrom. Accordingly, it is intended by the appended claims to cover all such changes and modifications as come within the spirit and scope of the invention.

What is claimed is:

1. A combination deodorant and body spray dispenser unit, comprising:

a container having a body portion and a cap portion, the body portion being hollow and having a side wall with an outer surface;

a roll-on deodorant stick having a stick body and an applicator tip and being movably mounted in the body portion of the container for movement into and out of the body portion of the container;

a spray system located in the body portion of the container and comprising: a spray nozzle located on the side wall of the body portion; a fluid reservoir located inside the body portion of the container; a control button located on an outer surface of the body portion of the container, the spray nozzle being fluidically connected to the fluid reservoir by the control button; and a locking element located on the side wall of the body portion and functionally connected to the control button; and a deodorant stick moving system comprising: a ring gear movably mounted on the body portion of the container to move around the outer surface of the sidewall of the body portion of the container, the ring gear being annular and having an outer surface and an inner surface; a screw thread on the inner surface of the ring gear; a screw thread affixed to the roll-on deodorant stick and having a screw thread threadably engaged with the screw thread on the inner surface of the ring gear to move the deodorant stick into and out of the body portion of the container under the influence of the screw thread on the ring gear when the ring gear is rotated on the body portion.

2. A combination deodorant and body spray dispenser unit, comprising:

a container having a body portion and a cap portion;

a deodorant stick movably located inside the body portion of the container for movement into and out of the body portion of the container and having a screw thread;

a deodorant stick moving system including a ring gear movably mounted on the body portion of the container, the ring gear having an inner surface with a screw thread for engagement with the screw thread of the deodorant stick for movement of the deodorant stick into and out of the body portion of the container; and a spray system in the body portion of the container and comprising a spray nozzle, a fluid reservoir in the body portion of the container, a control button on the body portion of the container with the fluid reservoir being connected to the spray nozzle through the control button, and a locking element.

3. The combination deodorant and body spray dispenser unit of claim 2, wherein the body portion of the container has a sidewall and wherein the spray nozzle of the spray system is located on the sidewall of the body portion of the container.

4. The combination deodorant and body spray dispenser unit of claim 3, wherein the body portion of the container further includes an outer surface and wherein the control button of the spray system is located on the outer surface of the body portion of the container.

5. The combination deodorant and body spray dispenser unit of claim 4, wherein the locking element of the spray system is located on the sidewall of the body portion of the container.

6. The combination deodorant and body spray dispenser unit of claim 5, wherein the fluid reservoir of the spray system is located inside the container adjacent to the deodorant stick.

* * * * *